166-273 SR
10/6/81 OR 4,293,035 found in 166/271 SR 4/19/84

United States Patent [19]

Fitch

[11] 4,293,035

[45] Oct. 6, 1981

[54] SOLVENT CONVECTION TECHNIQUE FOR RECOVERING VISCOUS PETROLEUM

[75] Inventor: John L. Fitch, Dallas, Tex.

[73] Assignee: Mobil Oil Corporation, New York, N.Y.

[21] Appl. No.: 46,275

[22] Filed: Jun. 7, 1979

[51] Int. Cl.[3] ..... E21B 43/22

[52] U.S. Cl. ..... 166/273; 166/271

[58] Field of Search ..... 166/271–274

[56] References Cited

U.S. PATENT DOCUMENTS

| | | | |
|---|---|---|---|
| 2,897,894 | 8/1959 | Draper et al. | 166/272 |
| 2,968,350 | 1/1961 | Slobod et al. | 166/245 |
| 3,080,917 | 3/1963 | Walker | 166/273 |
| 3,101,782 | 8/1963 | Holm | 166/273 X |
| 3,221,813 | 12/1965 | Closmann et al. | 166/272 X |
| 3,245,467 | 4/1966 | Fitch | 166/273 |
| 3,270,809 | 9/1966 | Connally, Jr. et al. | 166/273 X |
| 3,366,176 | 1/1968 | Parrish | 166/272 X |
| 3,386,513 | 6/1968 | Holmes | 166/274 |
| 3,500,916 | 3/1970 | van der Knapp et al. | 166/272 |
| 3,500,917 | 3/1970 | Lehner et al. | 166/272 |
| 3,648,771 | 3/1972 | Kelly et al. | 166/273 X |
| 3,838,738 | 10/1974 | Redford et al. | 166/271 |
| 3,854,531 | 12/1974 | Carlin | 166/272 |
| 3,954,139 | 5/1976 | Allen | 166/272 |
| 3,983,939 | 10/1976 | Brown et al. | 166/272 X |
| 4,004,636 | 1/1977 | Brown et al. | 166/272 |
| 4,109,720 | 8/1978 | Allen et al. | 166/272 X |
| 4,124,072 | 11/1978 | Redford | 166/272 X |

FOREIGN PATENT DOCUMENTS

| | | | |
|---|---|---|---|
| 840789 | 5/1970 | Canada | 166/272 |

*Primary Examiner*—James A. Leppink
*Assistant Examiner*—George A. Suchfield
*Attorney, Agent, or Firm*—C. A. Huggett; M. G. Gilman; H. M. Flournoy

[57] ABSTRACT

Disclosed is a method of producing viscous hydrocarbons from a viscous petroleum-containing subsurface formation. At least an injection well and a production well are provided to extend from the surface of the earth into the subsurface formations. A high mobility, brine-filled channel is established through the lower portion of the subsurface formation to communicate with the injection and production well. After the high mobility channel is established, a solvent for the petroleum is injected into the high mobility channel. The injection of the solvent is continued until breakthrough of the solvent at the production well and thereafter until the ratio of petroleum to solvent produced from the production well becomes unfavorable. Thereafter, gas is injected into the high mobility channel to displace the solvent and petroleum from the formation to the production well.

3 Claims, No Drawings

SOLVENT CONVECTION TECHNIQUE FOR RECOVERING VISCOUS PETROLEUM

BACKGROUND OF THE INVENTION

This invention is directed to a method of recovering petroleum from viscous petroleum-bearing subsurface formations. More particularly, this invention is directed to a solvent recovery method for recovering petroleum from subsurface formations that are penetrated by at least one injection well and one production well which extend from the surface of the earth and into the subsurface formation containing viscous hydrocarbons.

In U.S. Pat. No. 2,968,350 there is described a method for increasing the recovery of oil from reservoirs by the use of a miscible slug of fluid of a particular size. A slug of miscible fluid of a predetermined size is injected into a well followed by a slug of normally gaseous hydrocarbons of a predetermined size. The slug of hydrocarbon gases is then followed by water. U.S. Pat. No. 3,221,813 discloses a method of recovering petroleum materials from subterranean formations containing viscous tar-like petroleum materials by thermally driving the materials from the formations. In carrying out the method, a fracture is extended through the formation to communicate with an injection and a production well and a hot gas is pumped into the fracture at a pressure that is less than the fracture to the production well. Thereafter the injection of hot gas is terminated and a vapor-free liquid capable of entraining viscous petroleum materials is pumped into the fracture. Subsequently, the injection of the vapor-free liquid is terminated and the pumping of the hot gas is resumed.

In U.S. Pat. No. 3,366,176 there is described a method of recovering high viscosity oils by conducting heat wherein a well-to-well fracture is first created and propped with a material that will not melt at steam injection temperature but will melt at temperatures between steam injection and combustion temperatures. Alternatively the fracture is propped with a material that is readily oxidizable. Steam is then injected until breakthrough occurs or oil-producing rates decline. The proppant is then melted or oxidized and steam injection or other thermal recovery methods are continued. U.S. Pat. No. 3,386,513 is directed to a method of recovering viscous crude oil from a formation having a low permeability to fluids, significant porosity and amounts of oil-in-place, existing fractures and a finite gas saturation without a useful gas drive. Light hydrocarbons in a liquid state are injected from a well into the formation without creating fractures in an amount to fill up existing fractures and then an additional amount not in excess of the gas saturation volume of the formation within the wells' drainage radius exposed to the hydrocarbons. The well is shut in until the borehole pressure decline ceases. Thereafter the light hydrocarbons are produced with oil, in a liquid state, from the well.

In U.S. Pat. No. 4,004,636 there is described a method of recovering petroleum from viscous petroleum-containing formations including tar sand deposits by injecting into the formation a multicomponent solvent for the petroleum and a thermal fluid. In U.S. Pat. No. 4,109,720 petroleum is recovered from viscous petroleum-containing formations by injecting into the formation a solvent which is liquid at the formation conditions and simultaneously therewith injecting a substance which remains totally gaseous at the pressure and temperature conditions existing within the reservoir. In U.S. Pat. No. 4,124,072 there is described a method for treating a high permeability communication channel between wells for use in a viscous oil recovery method to stabilize fine particulate matter present in the communication channel to prevent movement of fine particles during the oil recovery process. U.S. Pat. No. 3,954,139 is directed to a method of recovering oil by injecting a miscible fluid to drive the oil vertically downward to the producing wells wherein the injected miscible fluid is heated so that it has a temperature equal to or greater than the normal reservoir fluid temperature.

SUMMARY OF THE INVENTION

This invention is directed to a method of recovering viscous petroleum from a viscous petroleum-bearing subsurface formation penetrated by at least one injection wall and one production well. A high mobility channel is established through the lower portion of the subsurface formation intermediate the injection well and the production well and a solvent for the viscous petroleum is injected via the injection well into the high mobility channel and petroleum is produced from the formation via the production well. The injection of solvent is continued until the solvent breaks through at the production well and until the ratio of produced petroleum to solvent becomes unfavorable. Thereafter the injection of solvent is terminated and gas is injected via the injection well into the high mobility channel and solvent and petroleum are produced from the formation.

DESCRIPTION OF THE PREFERRED EMBODIMENTS

This invention relates to a solvent recovery method for recovering viscous petroleum from a viscous petroleum-containing subsurface formation that has no significant vertical permeability barriers in the portion of the formation to be tested. More particularly, this invention relates to a gravity convection technique for recovering viscous petroleum.

Viscous petroleum is a term used to identify petroleum having relatively high viscosity and includes those petroleums referred to as tars. Such viscous petroleums are also referred to as heavy oils. In general, the term viscous petroleum is used to include those heavy oils and tars such as are commonly found in formations referred to as tar sands that have viscosities that are great enough to severely rstrict the production of the petroleums from the formations in which they are found. The API gravity of such viscous petroleums are normally 20° API or less.

In accordance with this invention, at least an injection well and a production well are provided which extend from the surface of the earth and communicate with the viscous petroleum-containing subsurface formation. These injection and production wells may be completed by conventional techniques and are perforated only adjacent the lower portion of the viscous petroleum-containing formation. A high mobility channel is established intermediate the injection and production wells through the lower portion of the viscous petroleum-containing formation. Thereafter solvent is injected via the injection well through this high mobility channel until it breaks through at the production well and petroleum is produced from the formation via the production well. Solvent injection is normally continued after breakthrough of the solvent at the production well until an unfavorable ratio of petroleum to solvent is reached and thereafter the injection of solvent is terminated. Thereafter gas is injected via the injection well into the high mobility channel and solvent and petroleum are produced from the formation via the production well to the surface of the earth.

The high mobility channel through the lower portion of the viscous petroleum-containing subsurface formation is formed by injecting a brine having a specific gravity greater than the specific gravity of the petroleum in the subsurface formation down the injection well and through the perforations therein and into the petroleum-containing subsurface formation until the brine breaks through at the production well. In some formations brine may underlie the petroleum contained in the subsurface formation. In such cases an oil-water contact will exist in the formation and no additional brine need be injected into the formation to establish the high mobility channel. In such cases it will be considered that the high mobility channel is established by determining the existence of the oil-water contact and the brine-filled portion of the formation that underlies the petroleum contained therein and communicates with the injection and the production well.

In the case of a viscous petroleum-containing formation that is not underlain by water the injection and production wells are perforated adjacent the lower portion of the formation. The perforation intervals that are provided in each of the injection and production wells desirably are no longer than about 10 percent of the total viscous petroleum-containing interval or, in other words, no greater in length than 10 percent of the thickness of the viscous petroleum-containing subsurface formation. In the case of a petroleum-containing formation that is underlain by water and thus has an oil-water contact, the injection well is perforated and the perforation interval is provided adjacent underlying water. Desirably the upper perforations of this perforation interval are located about adjacent the oil-water contact though it could extend somewhat above this oil-water contact without seriously affecting the efficiency of the present recovery method. The production well is perforated and the perforation interval is provided adjacent the viscous petroleum-containing formation such that the lower perforation of this interval is located slightly above the oil-water contact. Again in the case of a formation underlain by water, as it was with the formation that was not underlain by water, the perforation intervals that are provided in the injection and production wells desirably are no longer than about 10 percent of the total viscous petroleum-containing interval.

A solvent for the viscous petroleum is then injected via the injection well into this brine-filled high mobility channel. The solvent is selected to have a specific gravity less than that of the brine and less than that of the petroleum contained in the viscous petroleum-containing formation. The injected solvent being lighter than the brine in the high mobility channel will tend to override the brine contained therein and flow through the channel in contact with the petroleum-containing formation immediately above the high mobility channel. The solvent being lighter than the petroleum contained in the viscous petroleum-containing formation, that is, having a specific gravity less than the specific gravity of the petroleum contained therein, will tend to flow by gravity-driven convection upward into the petroleum-containing formation and solubilize the petroleum and form a liquid mixture of solvent and petroleum. As the petroleum goes into solution in the solvent the density of the petroleum-solvent mixture will increase, thereby causing the mixture to flow by gravity back downwardly toward the lower portion of the formation and into the high mobility channel. The solvent flowing along and through the channel carries the petroleum-solvent mixture along with it and causes the petroleum-solvent mixture to be produced from the formation into the production well where it is produced to the surface of the earth. The injection of the solvent via the injection well into the high mobility channel is continued until the solvent breaks through at the production well and until an unfavorable ratio of petroleum to solvent is produced therefrom. The unfavorable ratio depends primarily upon economic considerations but will be reached when the amount of petroleum carried by the solvent into the production well becomes small as compared to the amount of solvent flowing into the production well. Thereafter the injection of solvent is terminated and gas is injected into the high mobility channel and the production of solvent and petroleum from the formation into the production well is continued. The gas being lighter than the solvent tends to rise above the solvent and form as free gas thereabove. This free gas above the solvent may be considered as a gas cap. The continued injection of gas into the high mobility channel increases the size of the gas cap and displaces both the solvent and displaceable petroleum from the viscous petroleum-containing formation into the injection well.

The viscous petroleum-containing subsurface formation to be treated by the present solvent recovery method must be one that has no significant vertical permeability barriers in that portion of the formation to be treated. This allows the solvent that is injected into the brine-filled high mobility channel to flow upward into the formation by convection forces thus solubilizing the petroleum and forming a solvent-petroleum mixture of increased specific gravity which then flows because of gravity toward the high mobility channel where it is swept to the production well.

Suitable solvents for use in accordance with this method are those which will remain liquid under the temperature and pressure conditions that exist in the subsurface viscous petroleum-containing formation and which have a specific gravity less than that of the petroleum and less than that of the brine injected or naturally present in the formation and which will solubilize the petroleum and not cause solids such as asphaltenes to precipitate from the petroleum in amounts sufficient to seriously plug the pores of the formation. Light oils and condensates are generally suitable as solvents. Such light oils and condensates desirably will have an API gravity of at least 15 API degrees greater than the API gravity of the petroleum contained in the viscous petroleum-containing subsurface formations. It may be desirable to include in the solvents a small amount of aromatic material such as aromatic refinery stock to make the solvent compatible with the petroleum contained in the formations and to prevent the deposition of solid or gelatinous materials such as asphaltenes therefrom.

In the case of thick formations containing viscous petroleum, it may be desirable after production has declined to reperforate the injection and production wells at higher intervals and repeat the steps of this invention.

What is claimed is:

1. A method of recovering viscous petroleum from a viscous petroleum-bearing subsurface formation penetrated by at least one injection well and one production well comprising:

(a) establishing a high mobility channel through the lower portion of said subsurface formation intermediate said injection well and said production well wherein said high mobility channel is established by injecting a brine having a density greater than the density of said petroleum into the lower portion of said subsurface formation and continuing to inject said brine until breakthrough at said production well;

(b) injecting a solvent for said viscous petroleum via said injection well into said high mobility channel and producing petroleum from said formation via said production well;

(c) continuing step (b) until the ratio of produced petroleum to solvent becomes unfavorable and thereafter terminating the injection of solvent; and (d) thereafter injecting gas via said injection well into said high mobility channel and producing solvent and petroleum from said formation.

2. A method of recovering viscous petroleum from a viscous petroleum-containing subsurface formation having no significant vertical permeability barriers therein comprising:

(a) providing an injection well and a production well that extend from the surface of the earth and communicate with said formation;

(b) providing a perforation interval in said injection well adjacent only the lower portion of said formation;

(c) providing a perforation interval in said production well adjacent only the lower portion of said formation;

(d) injecting via said injection well into said formation a brine having a specific gravity greater than the specific gravity of said petroleum and continuing the injection of said brine until breakthrough at said production well to form a high mobility channel through the lower portion of said formation intermediate said injection well and said production well and thereafter terminating the injection of said brine;

(e) injecting a solvent for said viscous petroleum via said injection well into said high mobility channel, said solvent having a specific gravity less than the specific gravity of said brine and less than the specific gravity of said petroleum, and producing petroleum from said formation via said production well;

(f) continuing step (e) until the ratio of produced petroleum to solvent becomes unfavorable and thereafter terminating the injection of said solvent; and (g) thereafter injecting gas via said injection well into said high mobility channel and producing solvent and petroleum from said formation.

3. The method of claim 2 wherein said perforation intervals in said injection well and in said production well are no greater in length than about 10 percent of the thickness of said viscous petroleum-containing subsurface formation.

* * * * *